US009834886B2

(12) United States Patent
Blanc et al.

(10) Patent No.: US 9,834,886 B2
(45) Date of Patent: Dec. 5, 2017

(54) ENZYMATIC PRETREATMENT OF WOOD IN A METHOD FOR PRODUCING MECHANICAL PAPER PULP

(75) Inventors: Jérôme Blanc, Brignais (FR); Christophe Calais, Meyzieu (FR); Valérie Meyer, Saint Martin D'Heres (FR); Michel Petit-Conil, Grenoble (FR)

(73) Assignee: ARKEMA FRANCE, Colombes (FR)

( * ) Notice: Subject to any disclaimer, the term of this patent is extended or adjusted under 35 U.S.C. 154(b) by 0 days.

(21) Appl. No.: 14/347,753

(22) PCT Filed: Sep. 6, 2012

(86) PCT No.: PCT/FR2012/051998
§ 371 (c)(1),
(2), (4) Date: Mar. 27, 2014

(87) PCT Pub. No.: WO2013/045782
PCT Pub. Date: Apr. 4, 2013

(65) Prior Publication Data

US 2014/0231034 A1 Aug. 21, 2014

(30) Foreign Application Priority Data

Sep. 30, 2011 (FR) ..... 11 58871

(51) Int. Cl.

| | |
|---|---|
| ***D21B 1/02*** | (2006.01) |
| ***D21C 5/00*** | (2006.01) |
| ***D21H 11/18*** | (2006.01) |
| ***D21C 9/16*** | (2006.01) |
| *D21C 9/10* | (2006.01) |

(52) U.S. Cl.
CPC ..... *D21B 1/021* (2013.01); *D21B 1/02* (2013.01); *D21C 5/005* (2013.01); *D21C 9/163* (2013.01); *D21H 11/18* (2013.01); *D21C 9/10* (2013.01)

(58) Field of Classification Search
CPC ..... D21B 1/02; D21B 1/021
See application file for complete search history.

(56) References Cited

U.S. PATENT DOCUMENTS

| | | | | |
|---|---|---|---|---|
| 6,103,059 | A * | 8/2000 | Call | 162/65 |
| 6,267,841 | B1 | 7/2001 | Burton | |
| 6,492,005 | B1 * | 12/2002 | Ohbayashi et al. | 428/32.29 |
| 2008/0189871 | A1 | 8/2008 | McAuliffe et al. | |

FOREIGN PATENT DOCUMENTS

| | | |
|---|---|---|
| EP | 0429422 | 5/1991 |
| EP | 0717143 | 6/1996 |
| EP | 0745154 | 12/1996 |
| EP | 1728917 | 12/2006 |
| WO | WO 91/11552 | 8/1991 |
| WO | WO 2008/081078 | 7/2008 |

OTHER PUBLICATIONS

Tromp et al., Mechanism of Laccase-TEMPO-Catalyzed Oxidation of Benzyl Alcohol, 2010, ChemCatChem, 2, p. 827-833.*
Call et al.,History, overview and applications of mediated lignolytic systems, especially laccase-mediator-systems (Lignozym process), 1997, Biotechnology, 53, p. 163-202.*
Sundholm editor, Mechnical Pulping,1999, Fapet Oy, p. 157-168 and 311-324.*
Minussi et al.,Laccase induction in fungi and laccase/N—OH mediator systems applied in paper mill effluent, Bioresource Technology, 2007, 98, p. 158-164.*
Search Report for PCT/FR2012/051998, European Patent Office, dated Nov. 13, 2012.

* cited by examiner

*Primary Examiner* — Anthony Calandra
(74) *Attorney, Agent, or Firm* — RatnerPrestia

(57) ABSTRACT

A method for producing mechanical paper pulp comprises: impregnating unprocessed wood, whereby unprocessed wood is exposed to an impregnating composition comprising at least a laccase enzyme and a formula mediator (I), wherein $R_1$ and $R_2$ are identical or different groups, chosen from among a hydrogen atom, a hydrocarbon chain, linear or branched, saturated or unsaturated, comprising 1 to 14 carbon atoms, wherein each hydrocarbon chain can be replaced by one or more functional groups chosen from among —OH, —$SO_3$, benzyl, amino, mercapto, keto or carboxyl, wherein $R_1$ and $R_2$ in combination can form a cyclical structure, to achieve impregnation of the wood; and mechanically refining the impregnated wood, such that a mechanical paper pulp is obtained. The disclosure also relates to an impregnating composition used in this method and to the use thereof in a method for producing mechanical paper pulp, as well as to a method for producing paper.

30 Claims, No Drawings

ENZYMATIC PRETREATMENT OF WOOD IN A METHOD FOR PRODUCING MECHANICAL PAPER PULP

CROSS REFERENCE TO RELATED APPLICATIONS

This application is the U.S. National Phase application of PCT International Application No. PCT/FR2012/051998, filed Sep. 6, 2012, and claims priority to French Patent Application No. 1158871, filed Sep. 30, 2011, the disclosures of which are incorporated by reference in their entirety for all purposes.

FIELD OF THE INVENTION

The present invention relates to a process for producing mechanical paper pulp. It also relates to a composition employed in this method, and to the use of this composition in a method for producing mechanical paper pulp. It relates, lastly, to a papermaking process.

BACKGROUND OF THE INVENTION

Paper pulps called "mechanical pulps" or "high-yield pulps" or "wood pulps" are obtained directly from wood by a sequence of mechanical treatments, generally referred to collectively as mechanical "refining", and carried out by means of grindstones and/or refiners. The mechanical paper pulp is subsequently subjected to a bleaching phase, which may comprise one or more stages, depending on the degree of whiteness required.

The advantage of a mechanical pulp production process is its high material yield as compared with a "chemical" pulp production method. The reason is that, unlike the chemical pulp production methods, in which the lignin present in the untreated wood is removed almost entirely by cooking in the presence of chemical products, around 90% of the untreated wood is conserved in the pulps obtained at the outcome of a mechanical pulp production method.

The mechanical refining in a mechanical pulp production method typically comprises a number of refining steps, such as a primary refining operation, generally called "defibering", a secondary refining operation, a tertiary refining operation, an operation of refining screening wastes, etc. These refining steps provide pulps which have different degrees of refining, in order to progressively transform the wood into individualized fibers and so to allow the production of paper pulp.

Mechanical refining has the drawback of being highly energy-consuming, consuming typically from 1500 to 3000 kWh per metric ton of mechanical pulp produced. This energy on the one hand represents a substantial cost and on the other hand may cause damage to the wood fibers. Various pathways have therefore been conceived in order to reduce the required energy.

Accordingly, document EP 1728917 proposes carrying out a refining operation at low consistency, in other words at low pulp dry matter content. A treatment of this kind, however, requires a host of apparatus, and is of limited efficacy.

Document WO 08081078, in turn, proposes a mechanical pulp production method comprising a step of ozone treatment during refining. This treatment, however, has the drawback of giving rise to chromophoric groups on the polysaccharide molecules contained in the wood, these groups proving difficult to oxidize when the pulp is subsequently bleached conventionally.

Moreover, a particular interest has developed in enzymatic wood treatments within mechanical pulp production methods, owing to their gentle environmental impact.

Known accordingly is document U.S. Pat. No. 6,267,841, which describes a mechanical pulp production method comprising an enzymatic treatment step performed between two refining steps or prior to one refining step. The enzyme is selected from pectinases, xylanases, laccases, cellulases, manganese peroxidases, and mixtures thereof. These treatments, however, have the drawback of degrading the wood fibers, and/or require refining to be carried out at a high temperature, thereby limiting the energy saving that is realizable.

Documents EP 429422 and WO 91/11552 also describe mechanical pulp production methods which comprise a step of enzymatic pretreatment of a fibrous material for the purpose of facilitating its subsequent refining. In document EP 429422, the redox potential of the enzymes described is adjusted using regulators such as gaseous oxygen or nitrogen, antioxidants, sugars, organic acids, or inorganic salts. In document WO 91/11552, a recommendation is made to carry out the enzymatic pretreatment beyond a certain redox potential. Adjusting the redox potential of the enzymes, however, is a delicate operation, and proves to be costly.

Document EP 0745 154 describes a chemical pulp production method employing a multiple-component system for the modification, decomposition, or decoloring of the lignin, comprising in particular an oxidoreductase enzyme, a mediator, a free amine and an oxidizing agent. This system is employed for bleaching a chemical pulp which has been delignified with oxygen beforehand. This system has the drawbacks of generating effluents that are harmful to the environment, and of giving rise to high production costs.

Optimizing the enzymatic activity of laccases, moreover, has been studied in document U.S. 2008/0189871. This document proposes an LMS system (Laccase Mediator System) comprising a mediator derived from 2,6-dimethoxyphenol. This system is employed for bleaching a cloth. It is stated on the one hand that it may be used during the manufacture of pulp and on the other hand that it may be used during the bleaching of a pulp.

The methods and the products used in the prior art, therefore, do not provide complete satisfaction.

In particular there is still a need existing to reduce the energy demand of mechanical pulp production methods and to ensure, furthermore, a mechanical pulp having papermaking qualities that are equivalent to or an improvement on those obtained by the known techniques. There is also a need existing for a mechanical pulp having a degree of whiteness greater at the outcome of refining, and/or developing an improved capacity for bleaching, relative to those obtained by the known techniques. A need exists, lastly, to reduce the amount of chemical products required to bleach a mechanical pulp while ensuring an equivalent or improved degree of whiteness in relation to the mechanical pulps obtained with the techniques of the prior art.

SUMMARY OF THE INVENTION

The present invention accordingly provides a method for producing a mechanical paper pulp.

More specifically the invention relates in the first instance to a process for producing a mechanical paper pulp, comprising at least:

a step of impregnating an untreated wood, comprising contacting the untreated wood with an impregnating composition comprising at least one laccase enzyme and a mediator of formula (I):

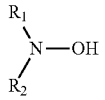

in which R1 and R2 are identical or different groups selected from a hydrogen atom and a saturated or unsaturated, linear or branched hydrocarbon chain comprising from 1 to 14 carbon atoms, it being possible for each hydrocarbon chain to be substituted by one or more functional groups selected from —OH, —SO3, benzyl, amino, mercapto, keto, and carboxyl, where R1 and R2 may together form a cyclic structure (as in piperidinyloxy compounds), to give an impregnated wood; and a step of mechanically refining the impregnated wood, so as to obtain a mechanical paper pulp.

More preferably, the process for producing a mechanical paper pulp of the invention comprises at least:

a step of impregnating an untreated wood, comprising contacting the untreated wood with an impregnating composition comprising at least one laccase enzyme and a mediator of formula (I):

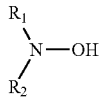

in which R1 and R2 are identical or different groups selected from a hydrogen atom or a C1 to C8 alkyl chain, to give an impregnated wood; and a step of mechanically refining the impregnated wood, so as to obtain a mechanical paper pulp.

Further preference among the mediators of formula (I) is given to those for which at least one of R1 and R2 is different from H. Even further preference is given to those for which R1=R2 and they each represent a C1-C8, more particularly C1-C6, and more preferably C1-C4 alkyl radical. One particularly preferred example would be N,N-diethylhydroxylamine.

The invention likewise relates to the impregnating composition employed in this method.

The invention also provides for the use of said impregnating composition in a method for producing mechanical paper pulp, for lowering the energy consumption of said method.

The invention further provides for the use of said impregnating composition in a method for producing mechanical paper pulp, for enhancing the whiteness of said pulp.

The invention also provides for the use of said impregnating composition in a method for producing mechanical paper pulp comprising a step of mechanical refining, said impregnating composition being used before the step of mechanical refining.

The invention provides, lastly, a papermaking process comprising the production of a mechanical paper pulp by the above method, and also to the use of this mechanical paper pulp for manufacturing paper.

The present invention may allow for the drawbacks of the prior art to be overcome. More particularly, it provides a method for producing mechanical paper pulp that is more energy-saving and which ensures a pulp and paper whose papermaking qualities are equivalent to or an improvement over those of the known methods. It likewise provides a mechanical paper pulp having a degree of whiteness that is greater at the end of refining and/or that develops a better capacity for bleaching, relative to the mechanical paper pulps obtained with the known methods. The invention also permits a reduction in the amount of chemical products to be employed for bleaching the mechanical paper pulp while ensuring a degree of whiteness at the outcome of bleaching that is at least equivalent to, or even greater than that of the mechanical paper pulps produced with the known methods. This is accomplished by virtue of a step of impregnating wood with a specific impregnating composition, prior to its refining.

More particularly, the composition according to the invention oxidizes the phenolic and nonphenolic units in the lignin, thereby weakening the bonds between the fibers. The Applicant has, in particular, developed an impregnating composition which acts specifically on the cell wall of the fibers, allowing the cohesion between the fibers to be reduced while at the same time preserving the fibers. Therefore, when the composition of the invention is used on wood prior to its refining, it allows a reduction in the energy it would be necessary to supply during refining in order to separate the fibers of the wood if no pretreatment was carried out, or if a prior-art technique was employed instead. Moreover, the length of the fibers obtained from the initial wood, and their strength, are preserved in the mechanical paper pulp produced and in the paper obtained from it.

Lastly, in contrast to the compositions proposed by the prior art, the impregnating composition according to the invention is inexpensive, available in large quantity and less toxic for the environment.

DEFINITIONS

A "mediator", according to the invention, is a compound which enhances the capacity of an enzyme to oxidize wood.

"Wood" means the entirety of the strong secondary (support, transfer, and reserve) tissues which form the trunks, branches, and roots of woody plants, in the sense of standard NF B 50-003.

By "untreated" wood is meant the condition of wood prior to its treatment with an impregnating composition according to the invention, and by "impregnated" wood is meant the condition of wood after its treatment with an impregnating composition according to the invention.

Unless otherwise specified, the percentages of material stated are percentages by weight.

Unless otherwise indicated, the percentages by weight of wood are given by weight of dry wood. "Dry wood" means that the wood has been dried in an oven in accordance with standard ISO 638:2008, namely at a temperature of from 103° C. to 107° C., for a time which is at least 30 minutes and does not exceed 16 hours, at atmospheric pressure.

The "consistency" of the mechanical paper pulp denotes the pulp concentration as defined in the ISO 4119 Standard of June 1996. This is the ratio of the dry mass of material which may be filtered from a sample of pulp in suspension, to the mass of the unfiltered sample, the test being carried out in accordance with said International Standard. The concentration of pulp is expressed herein as a percentage by mass.

Unless otherwise specified, the percentages by weight of mechanical paper pulp are given by weight of dry mechanical paper pulp. "Dry mechanical paper pulp" means the dry mass of material in a sample of pulp in suspension, as defined in the above ISO 4119 Standard, as measured after filtration and drying in accordance with said Standard.

Unless instructed otherwise, the measurements are performed at atmospheric pressure.

When reference is made to ranges, the expressions of the type "of from . . . to" include the endpoints of the range. Conversely, the expressions of the type "of between . . . and . . . " exclude the endpoints of the range.

DETAILED DESCRIPTION

The invention is now described in more detail and non-limitatively in the description which follows.

In schematic terms, the method for producing mechanical paper pulp according to the invention comprises at least:

- a step of impregnating untreated wood, comprising contacting the untreated wood with an impregnating composition according to the invention, to give an impregnated wood,
- a step of mechanical refining of the impregnated wood, to give a mechanical paper pulp.

In more detail, the method for producing mechanical paper pulp of the invention comprises, preferably in this order, the following steps:

- optionally an operation of steaming an untreated wood,
- optionally an operation of pressing an untreated wood,
- at least one step of impregnating an untreated wood with an impregnating composition according to the invention, to give an impregnated wood,
- optionally an operation of steaming the impregnated wood,
- at least one step of mechanically refining the impregnated wood, to give a mechanical pulp,
- optionally a step of chelating the mechanical pulp,
- optionally an operation of bleaching the mechanical pulp.

The starting material used is untreated wood.

According to one embodiment, the untreated wood is selected from coniferous woods, deciduous woods, or mixtures thereof. Suitable coniferous woods include Douglas fir, spruce, Aleppo pine, maritime pine, black pine, Scots pine, loblolly pine, red cedar (*Thulya plicata*), or mixtures thereof. Suitable deciduous woods include poplar, aspen, birch, maple, oak, eucalyptus, acacia, beech, chestnut, hornbeam, elm, or mixtures thereof. Preference is given to using spruce, poplar, eucalyptus, or a mixture thereof.

According to one embodiment, for producing a chemithermomechanical pulp (CTMP), the untreated wood may be selected from coniferous woods such as those stated above, deciduous woods such as those stated above, or else bamboo, hemp, cereal straw, as for example wheat straw or rice straw, cotton, or mixtures thereof.

According to one preferred embodiment, the untreated wood is in the form of chips. The term "chips" is employed in the sense conventional to the skilled person. It designates wood particles obtainable by any industrial process conventionally used in the mechanical pulp field. The size of the chips is typically subject to distribution in accordance with the standard SCAN-CM 40:01. This form facilitates in particular the subsequent impregnation treatment of the wood, and enhances its effectiveness. The chips may typically be obtained from debarked and cut logs of untreated wood, or from residual byproducts of the wood industry.

According to one embodiment, the wood, before or after the impregnating step, preferably before the impregnating step, undergoes at least one pretreatment selected from a thermal pretreatment, a chemical pretreatment, a mechanical pretreatment, or a combination of these. Suitable thermal pretreatment includes steaming, hot-water treatment, or a combination of these. Suitable chemical pretreatment includes an impregnating treatment on the wood with at least one chemical agent selected from an acid, a base, an oxidizing agent, a reducing agent, a chelating agent, a stabilizer, a surfactant, an enzyme, or mixtures thereof. Suitable mechanical pretreatment includes pressing.

According to one embodiment, the wood, before or after the impregnating step, preferably before the impregnating step, undergoes steaming, which gives the wood a uniform moisture content. Steaming comprises contacting the wood with steam. Steaming is preferably performed at atmospheric pressure. Steaming lasts preferably for from 5 to 30 minutes, more preferably from 10 to 20 minutes.

According to one embodiment, the untreated wood, before or after the impregnating step, preferably before the impregnating step, undergoes pressing. Pressing may be carried out using any means known to the skilled person, preferably using a compression device such as a screw press or a cylinder press.

The aforementioned embodiments may advantageously be combined with one another: according to one preferred embodiment, the untreated wood is initially in the form of chips, and the chips undergo steaming as defined above; according to another preferred embodiment, the untreated wood, before the impregnating step, undergoes steaming followed by pressing as defined above.

According to one particular embodiment, the wood does not undergo chemical pretreatment before the impregnating step, in particular no acid washing or chelation treatment.

The various pretreatments identified above may be performed before or after the impregnating step. They may also be repeated if necessary. For example, it is possible to perform one of these pretreatments before the impregnating step, to carry out the impregnating step, and then to repeat said pretreatment after the impregnating step.

The production method according to the invention comprises a step of impregnating untreated wood, comprising contacting the untreated wood with an impregnating composition according to the invention, to give an impregnated wood. Said impregnating composition comprises at least one laccase enzyme and a mediator with a specific formula. The impregnating composition according to the invention accordingly comprises a mediator of formula (I):

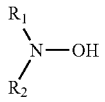

in which R1 and R2 are identical or different groups selected from a hydrogen atom or a C1 to C8 alkyl chain.

R1 and R2 are preferably identical or different groups selected from a hydrogen atom or a C1 to C4 alkyl chain. More preferably, R1 and R2 are identical or different C1 to C4 alkyl chains. Even more preferably, R1 and R2 are identical alkyl chains of formula C2H5: the preferred mediator is therefore diethyl hydroxylamine (DEHA).

The mediator may be present in the impregnating composition in pure form, in solution in water, or in the form of one of its salts.

The mediator content of the impregnating composition is preferably from 0.1% to 10% by weight, preferably from 0.15% to 4.5% by weight, preferably from 0.19% to 4% by weight, preferably from 0.19% to 3% by weight, or even from 0.23% to 2% by weight, relative to the total weight of the impregnating composition.

The mediator content, relative to the mass of dry untreated wood for treatment, is preferably from 0.1% to 10%, from 0.2% to 10%, from 0.2% to 5%, more preferably from 0.2% to 0.5%, or even from 0.25% to 0.5%, by weight of dry wood.

The laccase enzyme may be selected from class EC 1.10.3.2 of the enzymes nomenclature. *Mycellophthora laccase* is particularly preferred.

The laccase enzyme may be in crude extract form or in purified or semipurified form.

The amount of 1000 LAMU/mL laccase solution, relative to the mass of dry untreated wood for treatment, is preferably from 0.1 to 10 L/t, from 1 to 5 L/t, more preferably from 1 to 2 L/t of the dry untreated wood.

The amount of 1000 LAMU/mL laccase solution in the impregnating composition is preferably from 0.01% to 10% by weight, from 0.05% to 5% by weight, from 0.05% to 1% by weight, more particularly from 0.09% to 0.2% by weight, relative to the total weight of the impregnating composition.

The impregnating composition according to the invention may further comprise one or more additives usual for the skilled person, provided that their presence does not diminish the efficacy of the composition. Such additives may in particular be selected from the following: an enzyme other than laccase, an oxidizing agent, a reducing agent, an acid, a base, a chelating agent, a stabilizer, a surfactant, and combinations thereof. When present, the amount of total additive in the impregnating composition is preferably less than 3% by weight, more particularly less than 2% by weight, relative to the total weight of the composition. According to one embodiment, the impregnating composition does not comprise additive.

According to one embodiment, the impregnating composition is an aqueous solution. The water content of the composition then corresponds to the balance to 100% by weight of the sum of the amounts of mediator, of enzyme, and of optional additives.

According to one embodiment, the impregnating composition is used at a rate of 0.1 to 12 L/kg of the dry untreated wood for impregnation, preferably at a rate of from 1 to 10 L/kg of the untreated wood for impregnation. The excess impregnating composition may advantageously be recycled for carrying out a new impregnating step on another untreated wood or on the impregnated wood.

According to one embodiment, the contacting of the untreated wood with the impregnating composition comprises (or even consists of) spraying the impregnating composition onto the untreated wood, or immersing the untreated wood in a bath of impregnating composition.

According to one particular embodiment, the untreated wood is immersed in the impregnating composition for a time sufficient to allow impregnation of the wood with impregnating composition, after which the wood is withdrawn from the composition and left to incubate for a time sufficient to allow the enzyme to act on the wood. As a variant, the untreated wood is immersed in the impregnating composition and is left therein to incubate for a time sufficient to allow the enzyme to act on the wood. Incubation may be performed in any suitable device known to the skilled person, as for example in a storage vat.

According to one preferred embodiment, the contacting of the untreated wood with the impregnating composition is performed by spraying chips of untreated wood, which have been compressed, straight from a compression screw into a bath of impregnating composition. This allows optimum absorption by the chips (the chips draw up the composition in the manner of a sponge) and promotes the action of the composition at the core of the wood fibers.

Contacting of the untreated wood with the impregnating composition is preferably performed for a time of from 5 minutes to 240 minutes, from 25 minutes to 180 minutes, from 45 minutes to 120 minutes, more preferably from 55 min to 65 min. The impregnating composition is preferably employed at a temperature of from 35 to 80° C., from 40 to 70° C., more particularly from 45 to 55° C. It is preferably employed at a pH of from 3 to 11, from 4 to 7, more preferably from 4.5 to 5.5. Such conditions are advantageous for optimizing the efficacy of the composition according to the invention.

The impregnating step may be discontinued by steaming (contacting the impregnated wood with steam) or by washing with water, in order to halt the activity of the enzyme. The duration of the steaming or the washing with water is preferably from 1 to 10 minutes, more preferably from 3 to 7 minutes. Preference is given to steaming at atmospheric pressure.

The impregnating step is advantageously repeated a number of times, more particularly two to four times. The various aforementioned embodiments may also be combined with one another. Lastly, it should be noted that the impregnating composition may be prepared separately and then contacted with the untreated wood, as explained above, but may also be prepared directly in contact with the untreated wood. In this case, the various compounds of the impregnating composition are added successively and directly to the untreated wood.

Further to impregnation, the wood may be subjected to an additional treatment, referred to as aftertreatment. This aftertreatment involves contact with a chemical composition comprising an alkaline agent and a reducing agent. This aftertreatment is advantageous for softening the lignin and developing the mechanical characteristics of the fibers. It is advantageous more particularly when the aim is to produce a chemithermomechanical pulp (CTMP).

This step is preferably performed after the impregnating step, in order to prevent potential inhibition of the enzymes in the impregnating composition. It may be performed before or after the refining step. It is preferably performed between the impregnating step and the refining step, thereby allowing a greater energy saving to be made in the refining.

According to one embodiment, the contacting of the wood with the chemical composition comprises spraying of said composition onto the wood, or immersion of the wood into a bath of said composition.

According to one embodiment, the alkaline agent is selected from sodium hydroxide, magnesium hydroxide, potassium hydroxide, sodium carbonate, sodium bicarbonate, sodium silicate, or mixtures thereof. The alkaline agent is preferably selected from sodium silicate, sodium hydroxide, or a mixture thereof.

According to one embodiment, the reducing agent is selected from sodium sulfite $Na_2S_2O_3$, sodium bisulfite $NaHSO_3$, or a mixture thereof.

According to one embodiment, the alkaline agent is present in an amount of from 0.1% to 20% by weight, preferably from 1% to 10% by weight, relative to the weight of wood.

According to one embodiment, the reducing agent is present in an amount of from 0.1% to 30% by weight, preferably from 1% to 20% by weight, relative to the weight of wood.

The chemical aftertreatment step is preferably performed at a temperature of from 10° C. to 150° C., more particularly from 60° C. to 120° C. It is preferably performed for a time of from 1 minute to 120 minutes, preferably from 1 to 60 minutes.

The chemical aftertreatment step may be brought to an end by any means that stops the reaction of the chemical agents on the wood, as for example by washing with water.

The chemical aftertreatment step may advantageously be repeated a number of times, more particularly two times to four times, therefore allowing the papermaking capacities of the fibers to be reinforced further.

After the impregnating step (and the optional chemical aftertreatment step), the impregnated wood is mechanically refined, to give a mechanical paper pulp. The mechanical refining comprises primary mechanical refining (also called defibration), which is intended to pulp the wood optionally, followed by at least one secondary mechanical refining, which is intended to develop the papermaking capacities of the fibers. The secondary refining is optionally followed by one or more subsequent mechanical refining operations (tertiary refining, refining of wastes, etc.).

Mechanical refining is preferably carried out under pressure in order to allow more selective separation of the fibers.

Primary refining may be performed by milling or grinding the wood on a grindstone (in a stream of water) or in a disk refiner.

According to one embodiment, the primary refining of the wood is performed in a disk refiner. The pressure is preferably set so as to achieve a refining temperature of between 105° C. and 115° C. The pressure is advantageously from 0.5 to 5 bar, preferably from 1 to 3 bar. The rotary speed of the disks is preferably from 1000 to 5000 revolutions/minute, preferably from 1000 to 3000 revolutions/minute.

According to one embodiment, the secondary refining of the wood is performed in a disk refiner. Secondary refining is preferably performed under a pressure of from 0.1 to 5 bar, preferably from 0.5 to 3 bar. The rotary speed of the disks is preferably from 1000 to 5000 revolutions/minute, preferably from 1000 to 3000 revolutions/minute.

According to one embodiment, secondary refining is performed such that the resultant pulps have a degree of dewatering of from 250 to 50 mL CSF (Canadian Standard Freeness).

The refining step or steps subsequent to defibration may comprise a plurality of stages. For example, after defibration, the product may be separated into an accepted fraction and a rejected fraction, and the rejected fraction may be refined before being blended with the accepted fraction. Such intermediate separations may be provided a plurality of times.

At the outcome of refining, a mechanical paper pulp is obtained which may in particular be:

- a defibrator mechanical pulp (SGW) obtained from logs or blocks refined at atmospheric pressure using grinding disks;
- a pressure defibrator mechanical pulp (PGW) obtained from logs or blocks refined under pressure using grinding disks;
- a refiner mechanical pulp (RMP) obtained from chips or shives in refiners operating at atmospheric pressure;
- a thermomechanical pulp (TMP) or high-temperature thermomechanical pulp (HTMP) obtained from chips or shives in refiners after heat treatment of the wood by steaming at elevated pressure;
- a chemithermomechanical pulp (CTMP) obtained by chemical treatment in the presence of a chemical composition comprising an alkaline agent and a reducing agent at a temperature greater than or equal to 100° C. and by refining under pressure.

At the end of refining, a mechanical pulp is obtained which preferably has a brightness, measured in accordance with standard ISO 2470, of greater than or equal to 50%, preferably greater than or equal to 55%, ideally greater than or equal to 57%.

The specific energy saving achieved by virtue of the invention is advantageously greater than or equal to 10%, or even greater than or equal to 12%, or even greater than or equal to 14%, or even greater than or equal to 18% or even greater than or equal to 32%, by comparison with a method for producing a mechanical pulp obtained by refining pre-impregnated wood under the same conditions, but with water.

Chelation, when practiced, comes preferably after the impregnating step (that is, when the impregnating step has been accomplished), advantageously after refining, in order to prevent any possible inhibitory interaction with the enzyme. Chelation comprises contacting the mechanical paper pulp obtained from refining with a chelating composition comprising a chelating agent, said chelating composition being preferably an aqueous solution.

The chelating agent may be any chemical compound conventionally used for this purpose in the art. Preferably it involves ethylene diamine tetraacetic acid or one of its sodium salts, or diethylene triamine pentaacetic acid or one of its sodium salts.

The chelating agent possesses a particular affinity for the metal cations present as traces in the mechanical pulp. The objective of the chelation treatment is to neutralize these cations by sequestering them and withdrawing them from the mechanical pulp by washing of said pulp. Carrying out the chelating step makes a contribution to enhancing the performance level of a subsequent bleaching treatment (in particular with hydrogen peroxide).

The amount of chelating agent used in the chelating step is preferably from 0.05% to 3% by weight, preferably from 0.1% to 2% by weight, preferably from 0.2% to 1% by weight, more particularly from 0.3% to 0.5% by weight, relative to the weight of dry mechanical pulp.

The duration of the chelating step is preferably greater than or equal to about 30 minutes.

The chelating step is performed at a temperature of preferably from 4° C. to 95° C., preferably from 25° C. to 85° C., more preferably from 35° C. to 80° C. A temperature of about 60° C. is particularly appropriate.

The consistency of the mechanical pulp during the chelating step is preferably from 0.5% to 20% by weight of dry mechanical pulp, preferably from 2 to 15% by weight of dry mechanical pulp, more preferably from 3 to 12% by weight of dry mechanical pulp, relative to the weight of nondry mechanical pulp.

Bleaching comes preferably after chelation (or after refining, if no chelation is carried out), in other words when the chelating step (or the refining step if chelation is not carried out) has been accomplished.

Bleaching comprises contacting the mechanical paper pulp from the chelating step (or refining step if chelation is not carried out) with a bleaching composition.

The consistency during the bleaching step is preferably from 1% to 50% by weight of dry mechanical pulp, preferably from 10 to 40% by weight of dry mechanical pulp, more preferably from 20 to 30% by weight of dry mechanical pulp, relative to the weight of nondry mechanical pulp.

Bleaching has reaction kinetics that are more rapid at high consistency (whereas, for chelation, the reaction kinetics are rapid even at low consistency). It is possible to increase the consistency of the mechanical pulp, by pressing it, for example, and by removing filtrates comprising, in particular, the chelated metals.

Contacting takes place preferably by simple mixing of the bleaching composition with the pulp. The type of apparatus used for mixing is adapted to the consistency of the pulp: direct mixing by means of an injection pump if the consistency is low or medium (less than 10%); blender or mixer for a higher consistency (up to about 40%).

The bleaching composition is preferably an aqueous solution. The bleaching composition preferably comprises a bleaching agent and an alkaline agent.

The bleaching agent may be any chemical compound conventionally used for this purpose in the art. Preference is given to hydrogen peroxide or sodium hydrosulfite.

The amount of bleaching agent used is preferably from 0.5% to 10% by weight, preferably from 1% to 8% by weight, preferably from 1.5% to 6% by weight, more particularly from 2% to 4% by weight, relative to the weight of dry mechanical pulp.

The alkaline agent may be selected from alkaline metal and alkaline earth metal oxides, hydroxides, silicates, and carbonates, ammonia, aqueous ammonia, and mixtures thereof. The preferred basic species for selection of the alkaline agent including potassium hydroxide, sodium hydroxide, magnesium hydroxide, calcium hydroxide, sodium carbonate, sodium silicate, magnesium carbonate, and mixtures thereof. Sodium hydroxide, potassium hydroxide, or a mixture thereof is particularly preferred. The alkaline agent of the bleaching composition preferably comprises sodium silicate. Sodium silicate has an auxiliary function of stabilizing the bleaching agent (especially the hydrogen peroxide). In the bleaching composition it is also possible to provide another stabilizing agent, in addition to or instead of the sodium silicate. Polyhydroxyacrylate compounds constitute possible stabilizing agents.

The amount of alkaline agent used is preferably from 0.5% to 10% by weight, preferably from 1% to 6% by weight, preferably from 1.4% to 4% by weight, more particularly from 1.6% to 2.5% by weight, relative to the weight of dry mechanical pulp.

The bleaching composition may further comprise a chelating agent as defined above, especially if the chelating step is not carried out or ended at incomplete chelation.

It should be noted that the bleaching composition may be prepared separately and then contacted with the mechanical pulp, but it may also be prepared directly in contact with the mechanical pulp. In this second case, the various compounds of the bleaching composition are added successively and directly to the mechanical pulp.

The duration of the bleaching step varies with the type of agent used.

In the case of hydrogen peroxide, this duration is preferably from 10 minutes to 8 hours, preferably from 30 minutes to 6 hours, more preferably from 2 hours to 4 hours.

The bleaching step is carried out at a temperature of preferably from 4° C. to 95° C., preferably from 25° C. to 85° C., more preferably from 35° C. to 80° C. A temperature of about 70° C. is particularly suitable.

The bleaching step may be repeated a number of times, as for example twice.

At the end of the first bleaching, a mechanical pulp is obtained which preferably has a brightness, measured in accordance with standard ISO 2470-2:2008, of greater than or equal to 57%, more preferably of greater than or equal to 60%, ideally greater than or equal to 62% or even greater than or equal to 65%.

The invention relates, lastly, to a papermaking process that comprises producing mechanical paper pulp by the method above, then using this mechanical pulp to manufacture paper.

The mechanical pulp may in particular be dried and converted to sheets in a paper machine conventional in the art.

The mechanical pulp may also be introduced into a wet machine, in order to be dried and preformed into sheets. The sheets may be baled, before being transferred to a papermaking plant, where they may undergo subsequent treatments.

The tearing resistance of the paper obtained by implementation of the present invention (as measured in accordance with standard NF EN 21974 after the mechanical pulp has been formed into sheets in accordance with standard NF EN 5269-1) is advantageously increased by 3%, or even 9%, or even 11%, relative to a mechanical pulp obtained by refining wood preimpregnated with water.

Measurement Parameters

The activity of the laccase enzyme is expressed in LAMU/mL. One LAMU unit corresponds to the amount of laccase enzyme which, under given conditions (pH 7.5 and 30° C. temperature), breaks down 1 μmol of syringaldazine per minute. This activity can be determined on the basis of spectrophotometric absorbance measurements. The reason is that, in the course of the reaction in which a laccase (E.C. 1.10.3.2), p-diphenol:dioxygene oxidoreductase, catalyzes the oxidation of syringaldazine (4,4'-[azinobis(methanylylidine)]bis(2,6-dimethoxyphenol)) to the corresponding quinone (4,4'-[azobis(methanylylidine)]bis(2,6-dimethoxycyclohexa-2,5-dien-1-one), there is a change in absorption by the syringaldazine at a wavelength of 530 nm.

The measurement uses:

- a 25 mM tris/malate buffer solution (pH 7.5) (prepared from 25 mL of a 1.0 M aqueous solution of tris (hydroxymethyl)aminomethane, 5 mL of a 1.0 M aqueous solution of maleic acid, and the amount of water sufficient to give 1 L of buffer solution),
- a 0.28 mM syringaldazine solution (prepared by diluting 25 mL of a 0.56 mM alcoholic solution of syringaldazine in the amount of water sufficient to give 50 mL of syringaldazine solution, the 0.56 mM alcoholic syringaldazine solution being itself obtained by dissolution of 10.0 mg of syringaldazine (Sigma S-7896) in the amount of 96% ethanol sufficient to give 50 mL of alcoholic syringaldazine solution),
- a 6% by weight aqueous solution of ethanol,
- an enzyme dilution solution (containing 25.0 g of PEG 6000, 5.0 g of Triton X-100, and an amount of water sufficient to give 0.5 L of solution). The test laccase samples are diluted by a factor F using this solution, to approach an activity of 0.18 LAMU/mL.

The absorbance measurements are carried out with the spectrophotometer at an operating temperature of 30° C.: a tank is prepared with 1 mL of buffer solution, 25 μL of diluted laccase, and finally 75 μL of a 0.28 mM syringaldazine solution are added. After brief mixing, acquisition of the absorbance measurement is initiated straight away, for radiation with a wavelength of 530 nm.

The activity is calculated according to the following formula:

$$\text{Activity (LAMU/mL)} = \Delta A_{530nm} \times 0.677 \times F$$

where $\Delta A_{530nm}$ is the difference in absorbance at 530 nm measured over the 60-90 seconds period, and F is the enzyme dilution factor.

The dewatering index, referred to as "Canadian Standard Freeness" (CSF), is measured in accordance with international standard ISO 5267-2. It conveys the ease with which water can be extracted from a mechanical paper pulp. The smaller the index, the poorer the dewatering of the mechanical pulp. This parameter is an indicator of the degree of refining achieved during mechanical refining of the pulp.

The brightness of the mechanical pulp is determined by measuring its diffuse blue reflectance factor as defined in standard ISO 2470-2: 2008.

For a test X, the gain in brightness corresponds to the difference between brightness measured at the end of bleaching QP, and the brightness measured at the end of refining.

The total specific refining energy is obtained by adding the values of electrical consumption measured for each of the steps prior to refining and up to its end (for example, compression of wood chips, defibration, and secondary refining).

For a test X, the energy saving achieved corresponds to the difference between the specific refining energy of a reference test, carried out under the same conditions as test X but with use of an abiotic impregnating composition, and the specific refining energy of the test X.

In order to evaluate the resistance of the fibers in the mechanical pulp produced, this pulp is formed into sheets in accordance with standard NF EN 52694, and the tearing resistance of the sheets is measured in accordance with standard NF EN 21974.

EXAMPLES

The examples which follow illustrate the invention without limiting it.

The starting materials used are as follows:

- fresh Norwegian spruce chips, supplied by the Holmen company,
- chips from fresh poplar logs, supplied by a forestry enterprise in the Lyons region,
- fresh Spanish eucalyptus chips, supplied by the Ence company,
- *Myceliophthora laccases* sold by the Novozymes company under reference NS51003, having an activity of 1000 LAMU/mL as measured in accordance with the protocol indicated above,
- diethylhydroxylamine (DEHA) sold by the Arkema company,
- 4-hydroxy-3,5-dimethoxybenzaldehyde (syringaldehyde),
- diethylene triamine pentaacetic acid (DTPA),
- hydrogen peroxide,
- sodium silicate,
- sodium hydroxide,
- magnesium sulfate.

Table 1: Impregnating Composition

For each test, an impregnating composition in accordance with table 1 is prepared (the percentages are given by weight relative to the total weight of the composition). For this purpose, the water is heated to 50° C., the pH is adjusted to 5 by addition of sulfuric acid, and the commercial laccase solution and, lastly, the DEHA (or the syringaldehyde, where appropriate) are added. The impregnating compositions of tests 1, 6, and 9 are abiotic reference compositions. The compositions of tests 2, 4, and 5 are comparatives. The compositions in accordance with the invention are those of tests 3, 7, 8, 10, and 11.

The effective absorption capacity of the dry chips is 1.04 L of impregnating composition per kilogram of dry wood chips. For each test, the composition is used in excess, at a rate of 70 L per 10 kg of dry wood chips.

| | | Laccase solution at 1000 LAMU/mL | DEHA | Syringaldehyde | Water at pH 5 |
|---|---|---|---|---|---|
| TMP | Test 1 (ref) | | | | 100% |
| | Test 2 (comp) | 0.192% | | 1.92% | balance to 100% |
| | Test 3 (inv) | 0.192% | 1.92% | | balance to 100% |
| | Test 4 (comp) | 0.192% | | | balance to 100% |
| | Test 5 (comp) | | 1.92% | | balance to 100% |
| TMP | Test 6 (ref) | | | | 100% |
| | Test 7 (inv) | 0.096% | 0.48% | | balance to 100% |
| | Test 8 (inv) | 0.096% | 0.24% | | balance to 100% |
| CTMP | Test 9 (ref) | | | | 100% |
| | Test 10 (inv) | 0.096% | 1.92% | | balance to 100% |
| | Test 11 (inv) | 0.096% | 0.192% | | balance to 100% |

Tests 1 to 5: Thermomechanical Pulping (TMP) and Bleaching

Spruce wood chips are subjected to steaming at atmospheric pressure for 15 minutes, then introduced into a compression screw (6-inch model Modular Screw Device Impressafiner™ from Andritz AG), connected to a vat containing the impregnating composition. At the screw exit, the compressed chips are expelled directly into the impregnating composition, where they are left to incubate for 1 hour. The impregnating composition is extracted, and the chips are then subjected to steaming for 5 minutes to halt the enzymatic activity.

The chips pretreated in this way are transferred to a pilot-scale mechanical paper pulper (disk refiner), in which they are mechanically defibrated and then refined. Defibrating (primary refining) is performed at a pressure of 2 bar with disks rotating at 3000 revolutions/min. Secondary refining is performed at a pressure of 1 bar. The spacing between the disks is adjusted gradually so as to give five mechanical pulps with dewatering indices of 250 mL to 50 mL CSF. The brightness of the five mechanical pulps is measured according to standard ISO 2470-2:2008.

After refining, each resulting TMP mechanical pulp is bleached by a two-step method comprising a chelating step (Q) followed by hydrogen peroxide bleaching (P). In step Q, the consistency of the mechanical pulp is adjusted to 10% by weight. Step Q comprises contacting this mechanical pulp, at a temperature of 60° C. for 30 minutes, with 0.4% by weight of diethylene triamine pentaacetic acid (DTPA), relative to the total weight of dry mechanical pulp. During step P, the consistency of the mechanical pulp obtained at the outcome of step Q is adjusted to 25% by weight. Step P comprises contacting this mechanical pulp, at a temperature of 70° C. for 120 minutes, with a bleaching composition comprising 3% of hydrogen peroxide, 1.9% of sodium hydroxide, and 2% of sodium silicate, in percentages by weight relative to the total weight of dry mechanical pulp. The brightness of the five mechanical pulps is measured according to standard ISO 2470-2:2008.

The mechanical pulps are subsequently formed into sheets in accordance with standard NF EN 5269-1. The tearing resistance of the sheets is measured according to standard NF EN 21974.

The specific energy consumption is calculated as described earlier on above—that is, by adding up the energy consumption at each step in the mechanical pulp production method up to the end of refining: 1st steaming, compression/expulsion, 2nd steaming, defibration and subsequent refining operations.

The results are reported in table 2 below, following interpolation of the values to 100 mL CSF.

TABLE 2

| | TMP | | | | |
|---|---|---|---|---|---|
| | Test 1 (ref) | Test 2 (comp) | Test 3 (inv) | Test 4 (comp) | Test 5 (comp) |
| After refining | | | | | |
| Specific energy consumed (kWh/t) | 2480 | 2350 | 2170 | 2380 | 2360 |
| Energy saving/ref | ref | 52% | 12.5% | 4.0% | 4.8% |
| Brightness (%) ($B_R$) | 54.2 | 52.1 | 54 | 53.9 | 54.3 |
| After bleaching | | | | | |
| Brightness after QP (%) ($B_{QP}$) | 68.5 | 65.7 | 70.8 | 67.6 | 68 |
| Brightness gain $(B_{QP} - B_R)/B_R$ | 26.4% | 26.1% | 31.1% | 25.4% | 25.2% |
| After sheet formation | | | | | |
| Tearing resistance ($mNm^2/g$) | 6.2 | 6 | 6.4 | 5.8 | 4.8 |

Concerning the specific energy consumption of refining, test 3 according to the invention shows that:

- the invention allows a significant reduction in the specific energy consumption of refining;
- the combination of laccase and DEHA allows a greater reduction in the specific energy consumption of refining than the compounds taken separately (tests 4 and 5);
- in combination with laccase, DEHA allows a greater reduction in the specific energy consumption of refining than syringaldehyde (test 2).

Concerning the brightness of the mechanical pulp, test 3 according to the invention shows that:

- the invention allows a significant increase in the brightness of the mechanical pulp produced (test 1);
- the combination of laccase and DEHA allows an increase in the brightness of the pulp, in contrast to the compounds taken separately (tests 4 and 5 versus test 1);
- in combination with laccase, DEHA increases the brightness of the pulp more than syringaldehyde (test 2).

Concerning the tearing resistance of the paper, test 3 shows that the invention preserves the papermaking qualities of the fibers.

Tests 6 to 8: Effect of the Amount of Compounds in the Impregnating Composition

These complementary tests are carried out to determine the effect of the amount of reagents used in the impregnating composition according to the invention. The impregnating composition used for each test is given in table 1. The impregnating composition of test 6 corresponds to an abiotic reference composition. The compositions of tests 7 and 8 are in accordance with the invention. The procedure is exactly the same as for tests 1 to 4. The results are reported in table 3 below.

TABLE 3

| | | TMP | | |
|---|---|---|---|---|
| | | Test 6 (ref) | Test 7 (inv) | Test 8 (inv) |
| After Refining | Specific energy consumed (kWh/t) | 2451 | 2006 | 2595 |
| | Energy saving/ref | ref | 18.2% | −5.9% |
| | Brightness (%) ($B_R$) | 54.2 | 55 | 57.2 |
| After Bleaching | Brightness after QP (%) ($B_{QP}$) | 70 | 73 | 73.5 |
| | Brightness gain $(B_{QP} - B_R)/B_R$ | 29.2% | 32.7% | 28.5% |
| After sheet formation | Tearing resistance ($mNm^2/g$) | 6.44 | 7.05 | 7.20 |

Test 7 (by comparison with test 6) shows that, even when the amounts of laccase and DEHA are reduced, the impregnating composition according to the invention reduces the specific energy consumption of refining, increases the brightness of the mechanical pulp produced, and preserves the strength of the paper obtained from said pulp.

Test 8 (by comparison with tests 6 and 7) shows that below a certain mediator content, the impregnating composition no longer reduces the specific energy consumption of refining, but still increases the brightness of the mechanical pulp produced and preserves the strength of the paper obtained from said pulp.

Tests 9 to 11: Chemithermomechanical Pulping (CTMP) and Bleaching

Poplar wood chips are pulped according to steps of steaming, compression, and impregnation that are identical to those of tests 1 to 4. The impregnating composition used for each of the tests is indicated in table 1. In particular, the impregnating composition of test 9 corresponds to an abiotic composition which serves as reference. The compositions of tests 10 and 11 are in accordance with the invention.

A second treatment of the chips is performed by addition to the vat of 2% by weight of sodium sulfite and 1% by weight of sodium hydroxide, relative to the total weight of dry chips. The temperature of the medium is raised to 125° C., and the chips are left to impregnate for 15 minutes.

The impregnated chips are subjected to defibration at a pressure of 2 bar with disks rotating at 3000 revolutions per minute, and then to a second mechanical refining at atmospheric pressure. The spacing between the disks is adjusted progressively so as to give five mechanical pulps with dewatering indices of from 400 to 100 mL CSF. The brightness of the five mechanical pulps is determined according to standard ISO 2470-2:2008.

After refining, each mechanical pulp CTMP obtained is subjected to bleaching comprising three steps: one chelating step (Q), followed by two successive treatments with hydrogen peroxide (PP).

During step Q, the consistency of the mechanical pulp is adjusted to 10% by weight. Step Q comprises the contacting, at a temperature of 60° C. for 30 minutes, of this mechanical pulp with 0.4% by weight of diethylene triamine pentaacetic acid (DTPA), relative to the total weight of dry mechanical pulp.

During the first step P (P1), the consistency of the mechanical pulp obtained at the end of step Q is adjusted to 14% by weight. Step P1 comprises the contacting, at a temperature of 70° C. for 120 minutes, of this mechanical pulp with a bleaching composition comprising 2.2% of hydrogen peroxide, 1.5% of sodium hydroxide, 1% of sodium silicate, 0.075% of magnesium sulfate, in percentages by weight relative to the total weight of dry mechanical pulp. The brightness of the five mechanical pulps is determined according to standard ISO 2470-2:2008.

During the second step P (P2), the consistency of the mechanical pulp obtained at the end of step P1 is adjusted to 20% by weight. Step P2 comprises the contacting, at a temperature of 70° C. for 120 minutes, of this mechanical pulp with a bleaching composition comprising 3.4% of hydrogen peroxide, 1.7% of sodium hydroxide, 1.6% of sodium silicate, 0.075% of magnesium sulfate, in percentages by weight relative to the total weight of dry mechanical pulp. The brightness of the five mechanical pulps is determined according to standard ISO 2470-2:2008.

The specific energy consumption of the method is calculated for each mechanical pulp, as described earlier on above.

The results are reported in table 4 below, following interpolation of the values to 300 mL CSF.

TABLE 4

| | | CTMP | | |
|---|---|---|---|---|
| | | Test 9 (ref) | Test 10 (inv) | Test 11 (inv) |
| After refining | Specific energy consumed (kWh/t) | 1060 | 720 | 910 |
| | Energy saving/ref | ref | 32.1% | 14.2% |
| | Brightness (%) ($B_R$) | 37.2 | 41.6 | 43.2 |
| After bleaching | Brightness after QP (%) ($B_{QP}$) | 46.2 | 52 | 56.2 |
| | Brightness after QPP (%) ($B_{QPP}$) | 58.7 | 62 | 65.1 |
| | Brightness gain $(B_{QP} - B_R)/B_R$ | 24.2% | 25.0% | 30.1% |
| | Brightness gain $(B_{QPP} - B_R)/B_R$ | 57.8% | 49.0% | 50.7% |

Concerning the specific energy consumption:

tests 10 and 11 (by comparison with test 9), especially test 10, show that the use of an impregnating composition according to the invention during refining produces a significant reduction in the specific energy consumption of refining in the CTMP process.

Concerning the brightness of the mechanical pulp:

tests 10 and 11 (by comparison with test 9) show that the use of an impregnating composition according to the invention during refining produces a brighter mechanical pulp CTMP both at the end of refining and at the end of subsequent bleaching of said pulp;

the invention increases the brightness of the mechanical pulp obtained at the end of the first bleaching performed after refining.

The invention claimed is:

1. A method for producing mechanical paper pulp, comprising:

impregnating an untreated wood, comprising contacting the untreated wood with an impregnating composition comprising at least one laccase enzyme and a mediator of formula (I):

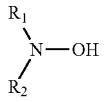

(I)

wherein $R_1$ and $R_2$ are identical or different C1 to C4 alkyl chains, to give an impregnated wood; and mechanically refining the impregnated wood to obtain a mechanical paper pulp, wherein the mechanical paper pulp is a defibrator mechanical pulp (SGW), a pressure defibrator mechanical pulp (PGW), a refiner mechanical pulp (RMP), a thermomechanical pulp (TMP), a high-temperature thermomechanical pulp (HTMP), or a chemithermomechanical pulp (CTMP).

2. The method of claim 1, wherein the mediator is diethyl hydroxylamine (DEHA).

3. The method of claim 1, wherein the impregnating composition is produced using, and relative to its total weight:

0.01% to 10% by weight of a laccase solution containing 1000 LAMU/mL of said solution, and 0.1% to 10% by weight of mediator.

4. The method of claim 1, wherein the impregnating composition is used at a rate of from 0.1 to 12 L/kg of the untreated wood for impregnation.

5. The method of claim 1, wherein the untreated wood is selected from coniferous woods, deciduous woods and mixtures thereof.

6. The method of claim 1, wherein the untreated wood is in the form of chips.

7. The method of claim 1, wherein the contacting during the impregnating step is performed for a time of from 5 min to 240 min.

8. The method of claim 1, wherein the impregnating step is performed at a temperature of from 35° C. to 80° C.

9. The method of claim 1, wherein the impregnating step is performed at a pH of from 3 to 11.

10. The method of claim 1, further comprising, before the impregnating step, steaming the untreated wood.

11. The method of claim 1, further comprising, before the impregnating step, pressing the untreated wood.

12. The method of claim 1, further comprising, at the end of the impregnating step, steaming the impregnated wood.

13. The method of claim 1, further comprising, after the refining step, bleaching the mechanical paper pulp, comprising contacting the mechanical paper pulp with a bleaching composition.

14. The method of claim 13, wherein the bleaching composition comprises a bleaching agent and at least one alkaline agent selected from: alkali metal and alkaline earth metal oxides, hydroxides, silicates, and carbonates, ammonia, aqueous ammonia, and mixtures thereof.

15. The method of claim 14, wherein the bleaching step is carried out using:

from 0.5% to 10% by weight of bleaching agent, relative to the total weight of mechanical paper pulp;

from 0.5% to 10% by weight of alkaline agent, relative to the total weight of mechanical pulp.

16. The method of claim 1, further comprising chelating the mechanical paper pulp by contacting the mechanical paper pulp with a chelating composition comprising a chelating agent.

17. The method of claim 1, wherein the impregnating composition is used at a rate of from 1 to 10 L/kg of the untreated wood for impregnation.

18. The method of claim 5, wherein the untreated wood is selected from a spruce wood, a poplar wood, a eucalyptus wood, and mixtures thereof.

19. The method of claim 1, wherein the contacting during the impregnating step is performed for a time of from 25 min to 180 min.

20. The method of claim 1, wherein the impregnating step is performed at a temperature of from 40° C. to 70° C.

21. The method of claim 1, wherein the impregnating step is performed at a pH of from 4 to 7.

22. The method of claim 10, wherein steaming the untreated wood comprising steaming for 5 min to 30 min.

23. The method of claim 10, further comprising pressing the untreated wood after steaming the untreated wood and before the impregnating step.

24. The method of claim 12, wherein steaming the impregnated wood comprising steaming the impregnated wood for 1 min to 10 min.

25. The method of claim 13, wherein the bleaching composition comprising a bleaching agent and at least one alkaline agent selected from potassium hydroxide, sodium hydroxide, magnesium hydroxide, calcium hydroxide, sodium silicate, sodium carbonate, magnesium carbonate, and mixtures thereof.

26. The method of claim 14, wherein the bleaching step is carried out using:

from 1% to 8% by weight of bleaching agent, relative to the total weight of mechanical paper pulp; and from 1% to 6% by weight of alkaline agent, relative to the total weight of mechanical pulp.

27. The method of claim 13, further comprising a chelating step between the refining step and the step of bleaching the mechanical paper pulp, comprising contacting the mechanical pulp with a chelating composition comprising a chelating agent selected from ethylene diamine tetraacetic acid, its sodium salts, diethylene triamine pentaacetic acid, and its sodium salts.

28. The method of claim 1, wherein the mechanical paper pulp is a thermomechanical pulp (TMP), or a chemithermomechanical pulp (CTMP).

29. A method for producing a mechanical paper pulp, comprising:

optionally steaming an untreated wood, optionally pressing the untreated wood, at least one step of impregnating the untreated wood with an impregnating composition comprising at least one laccase enzyme and a mediator of formula (I):

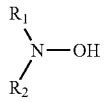

(I)

wherein $R_1$ and $R_2$ are identical or different $C_1$ to $C_4$ alkyl chains, to give an impregnated wood, to give an impregnated wood, optionally an operation of steaming the impregnated wood, at least one step of mechanically refining the impregnated wood, to give a mechanical paper pulp, optionally chelating the mechanical paper pulp, and optionally bleaching the mechanical paper pulp.

30. A mechanical pulp and papermaking process comprising:

impregnating an untreated wood, comprising contacting the untreated wood, with an impregnating composition comprising at least one laccase enzyme and a mediator of formula (I):

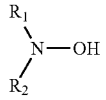

(I)

wherein $R_1$ and $R_2$ are identical or different $C_1$ to $C_4$ alkyl chains groups, give an impregnated wood; and mechanically refining the impregnated wood to obtain a mechanical paper pulp, wherein the mechanical paper pulp is a defibrator mechanical pulp (SGW), a pressure defibrator mechanical pulp (PGW), a refiner mechanical pulp (RMP), a thermomechanical pulp (TMP), a high-temperature thermomechanical pulp (HTMP), or a chemithermomechanical pulp (CTMP); manufacturing paper with the mechanical paper pulp.

* * * * *